US012612674B2

(12) United States Patent
Kim et al.

(10) Patent No.: US 12,612,674 B2
(45) **Date of Patent: *Apr. 28, 2026**

(54) STEEL PLATE HAVING HIGH STRENGTH AND EXCELLENT IMPACT TOUGHNESS AFTER DEFORMATION, AND METHOD FOR MANUFACTURING SAME

(71) Applicant: POSCO CO., LTD, Pohang-si (KR)

(72) Inventors: Woo-Gyeom Kim, Pohang-si (KR); Sang-Ho Kim, Pohang-si (KR); Young-Sub Byun, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 18/700,014

(22) PCT Filed: Nov. 30, 2022

(86) PCT No.: PCT/KR2022/019145

§ 371 (c)(1),
(2) Date: Apr. 10, 2024

(87) PCT Pub. No.: WO2023/121032

PCT Pub. Date: Jun. 29, 2023

(65) Prior Publication Data

US 2025/0243555 A1 Jul. 31, 2025

(30) Foreign Application Priority Data

Dec. 21, 2021 (KR) ..... 10-2021-0183516

(51) Int. Cl.

| | |
|---|---|
| ***C22C 38/02*** | (2006.01) |
| ***C21D 1/84*** | (2006.01) |
| ***C21D 6/00*** | (2006.01) |
| ***C21D 8/02*** | (2006.01) |
| ***C21D 8/0221*** | (2026.01) |
| ***C21D 8/0247*** | (2026.01) |
| ***C21D 9/46*** | (2006.01) |
| ***C22C 38/00*** | (2006.01) |
| ***C22C 38/04*** | (2006.01) |
| ***C22C 38/06*** | (2006.01) |
| ***C22C 38/44*** | (2006.01) |
| ***C22C 38/48*** | (2006.01) |
| ***C22C 38/50*** | (2006.01) |
| ***C22C 38/58*** | (2006.01) |

(52) U.S. Cl.

CPC ..... *C21D 9/46* (2013.01); *C21D 1/84* (2013.01); *C21D 6/004* (2013.01); *C21D 6/005* (2013.01); *C21D 6/008* (2013.01); *C21D 8/0205* (2013.01); *C21D 8/0226* (2013.01); *C21D 8/0263* (2013.01); *C22C 38/001* (2013.01); *C22C 38/02* (2013.01); *C22C 38/04* (2013.01); *C22C 38/06* (2013.01); *C22C 38/44* (2013.01); *C22C 38/48* (2013.01); *C22C 38/50* (2013.01); *C22C 38/58* (2013.01); *C21D 2211/005* (2013.01)

(58) Field of Classification Search

CPC ..... C22C 38/04

See application file for complete search history.

(56) References Cited

U.S. PATENT DOCUMENTS

| | | | | |
|---|---|---|---|---|
| 2017/0002435 | A1 | 1/2017 | Jeong et al. | |
| 2021/0404031 | A1 | 12/2021 | Chae | |
| 2024/0052450 | A1* | 2/2024 | Noh | B21C 37/08 |
| 2024/0417836 | A1* | 12/2024 | Kim | C22C 38/44 |

FOREIGN PATENT DOCUMENTS

| | | | | |
|---|---|---|---|---|
| EP | 3 561 115 | A1 | 10/2019 | |
| EP | 4092149 | B1 * | 1/2025 | C21D 1/78 |
| JP | 2007-321220 | A | 12/2007 | |
| JP | 2012-172258 | A | 9/2012 | |
| JP | 2016-223013 | A | 12/2016 | |
| JP | 2017-504722 | A | 2/2017 | |
| JP | 2022-505843 | A | 1/2022 | |
| KR | 1020130076578 | A | 7/2013 | |
| KR | 1020140098900 | A | 8/2014 | |
| KR | 10-2014-0106963 | A | 9/2014 | |
| KR | 10-2015-0035628 | A | 4/2015 | |
| KR | 10-2015-0074706 | A | 7/2015 | |
| KR | 10-2015-0074988 | A | 7/2015 | |
| KR | 10-2018-0074470 | A | 7/2018 | |
| KR | 10-1889182 | B1 | 8/2018 | |
| KR | 10-2019-0022845 | A | 3/2019 | |

(Continued)

OTHER PUBLICATIONS

English machine translation of JP 2012-172258 A of Nakajima (Year: 2012).*

(Continued)

*Primary Examiner* — Jophy S. Koshy
(74) *Attorney, Agent, or Firm* — Sughrue Mion, PLLC

(57) ABSTRACT

The present invention pertains to a steel plate and a method for manufacturing same. More specifically, the present invention pertains to a steel plate having high strength and excellent impact toughness after deformation, and a method for manufacturing same. A steel plate that has excellent strength and low-temperature impact toughness and may be applied as an extremely thick steel material for offshore wind power, and may also be used as a structural steel material for infrastructure industries such as construction and bridges, and a manufacturing method therefor may be provided.

5 Claims, 2 Drawing Sheets

(56) References Cited

FOREIGN PATENT DOCUMENTS

| | | | |
|---|---|---|---|
| KR | 10-2021-0127736 | A | 10/2021 |
| WO | 2021/144953 | A1 | 7/2021 |

OTHER PUBLICATIONS

Extended European Search Report dated Apr. 2, 2025 in Application No. 22911665.2.
International Search Report issued Feb. 27, 2023 in International Application No. PCT/KR2022/019145.
Communication dated Sep. 2, 2025, issued in Japanese Application No. 2024-536502.
Communication dated Mar. 20, 2026 issued by the Korean Patent Office in application No. 10-2021- 0183516.

* cited by examiner

STEEL PLATE HAVING HIGH STRENGTH AND EXCELLENT IMPACT TOUGHNESS AFTER DEFORMATION, AND METHOD FOR MANUFACTURING SAME

CROSS-REFERENCE TO RELATED APPLICATIONS

This is a National Stage of International Application No. PCT/KR2022/019145 filed Nov. 30, 2022, claiming priority based on Korean Patent Application No. 10-2021-0183516 filed Dec. 21, 2021.

TECHNICAL FIELD

The present disclosure relates to a thick steel plate and a method for manufacturing the same, and more specifically, to a thick steel plate having high strength and excellent impact toughness after deformation, and a method for manufacturing the same.

BACKGROUND ART

Since the 2000s, interest has been focused on environmental issues and renewable energy to reduce greenhouse gas emissions. Renewable energy is a term which refers to a combination of new energy (hydrogen, fuel cells, and the like) and renewable energy (solar heat, wind power, bio, and the like), and thereamong, wind power generation is attracting attention as a next-generation energy source, as an eco-friendly power generation method that does not generate waste and does not cause pollution. Among types of wind power generation, onshore wind power installed on land is limited in mission and a space for optimal wind formation, so recently, offshore wind power, installed in the sea, has been growing rapidly, especially in Europe.

Although offshore wind power was activated later than onshore wind power, the relative advantage of offshore wind power over onshore wind power is increasingly highlighted as the level of technology has advanced due to various advantages such as low concerns about wind speed, noise generation, and the ability to secure a large catchment area. In particular, offshore wind power has the great advantage of being able to increase power generation capacity per wind turbine compared to onshore wind power. In other words, average power generation capacity is about twice that of onshore wind power, and average capacity of new turbine installations per unit based on European standards is rapidly increasing from 4 MW in 2015 to 7.2 MW in 2019, and is expected to exceed 10M W within 2-3 years.

Accordingly, the strength of the applied thick steel plate gradually increased, and most thick steel plates had a yield strength of 325 MPa based on a thickness of 80 mm, but in the 20 s, thick steel plates having yield strengths of 380 and 410 MPa were being applied. A substructure of the offshore wind power is largely divided into monopile and jacket, and the jacket-type substructure is divided into a pinpile-type or a suction bucket-type depending on a method of fixation to the seafloor.

In the case of the monopile substructure, it is divided into a monopile portion inserted into the seafloor, and a transition piece portion connecting the monopile and a tower portion. In this structure, a load increases the most, and high-strength steel can be mainly applied to a connection portion of the monopile and the transition piece, which is a joint portion. The important support area of this offshore wind power substructure is formed of a thick steel plate which not only has high strength but can also guarantee extremely thick and low-temperature toughness, and during pipe construction with a cylindrical piping structure, it is important to secure impact toughness after deformation.

SUMMARY OF INVENTION

Technical Problem

An aspect of the present disclosure is to provide a thick steel plate having high strength and excellent impact toughness after deformation, and a method for manufacturing the same.

The subject of the present invention is not limited to the above. The subject of the present invention will be understood from the overall content of the present specification, and those of ordinary skill in the art to which the present invention pertains will have no difficulty in understanding the additional subject of the present invention.

Solution to Problem

According to an aspect of the present disclosure, a steel plate may be provided, the steel plate including by weight %: 0.04 to 0.08% of C, 0.1 to 0.35% of Si, 1.4 to 1.8% of Mn, 0.01 to 0.035% of sol.Al, 0.2 to 0.5% of Ni, 0.1 to 0.3% of Cr, 0.05 to 0.15% of Mo, 0.015 to 0.035% of Nb, 0.005 to 0.02% of Ti, 0.002 to 0.006% of N, 0.01% or less of P, 0.003% or less of S, with a balance of iron (Fe) and other inevitable impurities, wherein an R value defined in Relational expression 1 below is 0.85 to 1.35, a microstructure at a point equal to ¼ of a thickness thereof includes by area fraction, 40 to 60% of acicular ferrite, 40 to 60% of bainite, and 3% or less of a sum of residual cementite and MA, an average grain size of acicular ferrite at the point equal to ¼ of the thickness is 20 μm or less, and a microstructure in a portion 8 mm directly below a surface portion includes by area, 5% or less of a hard phase.

$$R = [Ni] + 3[Mo] + 2[Cr] \quad \text{[Relational expression 1]}$$

where [Ni], [Mo] and [Cr] are a weight percent of each element.

The hard phase may be an MA phase.

The steel plate may have an average grain size of acicular ferrite at the point equal to ¼ of the thickness of 10 to 20 μm.

The steel plate may have a thickness of 50 to 100 mm.

The steel plate may have a yield strength of 460 MPa or more and a tensile strength of 580 MPa or more.

The steel plate may have an impact toughness of 100 J or more at −50° C. on the surface and at the point equal to ¼ of the thickness of the steel plate after deformation, where deformation means that when an amount of deformation reaches 5%, during tensioning, tensioning is stopped and then an aging treatment is performed at 250° C.

According to another aspect of the present disclosure, a method for manufacturing a steel plate may be provided, the method including: reheating a steel slab comprising by weight %: 0.04 to 0.08% of C, 0.1 to 0.35% of Si, 1.4 to 1.8% of Mn, 0.01 to 0.035% of sol.Al, 0.2 to 0.5% of Ni, 0.1 to 0.3% of Cr, 0.05 to 0.15% of Mo, 0.015 to 0.035% of Nb, 0.005 to 0.02% of Ti, 0.002 to 0.006% of N, 0.01% or less of P, 0.003% or less of S, with a balance of iron (Fe) and other inevitable impurities, wherein an R value defined in the following Relational expression 1 is 0.85 to 1.35;

rolling the reheated steel slab in a recrystallization zone at a temperature range of 900° C. or higher with an amount of reduction of final pass of 15 to 25 mm;

rolling the steel plate rolled in the recrystallization zone in a non-recrystallization zone at a rolling finish temperature of Ar3+40 to Ar3+80; and cooling the steel plate rolled in the non-recrystallization zone to a temperature range of 400° C. or lower at a cooling rate of 5 to 10° C./s based on the point equal to ¼ of the thickness.

$$R = [Ni] + 3[Mo] + 2[Cr] \quad \text{[Relational expression 1]}$$

where [Ni], [Mo], and [Cr] are a weight percent of each element.

The reheating may be performed at a temperature range of 1020 to 1100° C., and when rolling is performed in the non-recrystallization zone, a cumulative reduction ratio may be 30 to 50%.

The steel plate may have a thickness of 50 to 100 mm.

Advantageous Effects of Invention

As set forth above, according to an aspect of the present disclosure, a thick steel plate having high strength and excellent impact toughness after deformation and a method for manufacturing the same may be provided.

According to an aspect of the present disclosure, a thick steel plate that has excellent strength and low-temperature impact toughness and may be applied as an extremely thick steel material for offshore wind power, and may also be used as a structural steel material for infrastructure industries such as construction and bridges, and a manufacturing method therefor may be provided.

BRIEF DESCRIPTION OF DRAWINGS

FIG. 1(A) is a photograph of a microstructure at a point 8 mm below the surface, and FIG. 1(B) is a photograph of a microstructure at a point equal to ¼ of the thickness.

BEST MODE FOR INVENTION

Figure 1A:
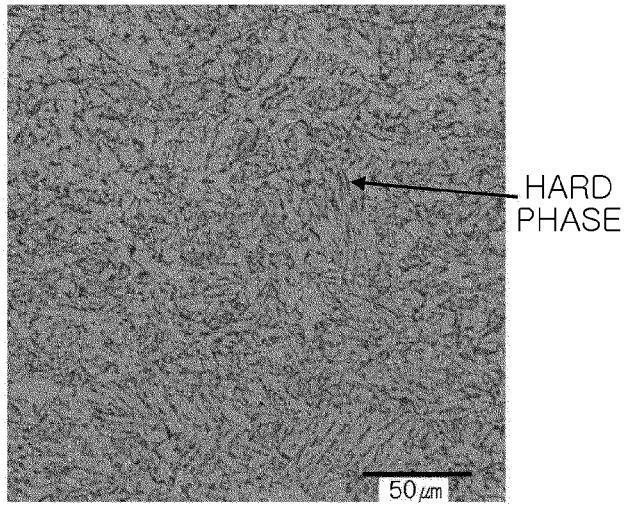
FIGS. 1(A) and 1(B) are photographs of the microstructure of Inventive Example according to an aspect of the present disclosure observed at 500× magnification using an optical microscope.

Hereinafter, preferred embodiments of the present disclosure will be described. Embodiments of the present disclosure may be modified in various forms, and the scope of the present disclosure should not be construed as being limited to the embodiments described below. The present embodiments are provided to those skilled in the art to further elaborate the present disclosure.

Hereinafter, the present disclosure is described in detail.

Hereinafter, the steel composition of the present disclosure will be described in detail.

In the present disclosure, unless otherwise specified, % indicating a content of each element is based on weight.

Steel according to an aspect of the present disclosure may comprise, by weight %: 0.04 to 0.08% of C, 0.1 to 0.35% of Si, 1.4 to 1.8% of Mn, 0.01 to 0.035% of sol.Al, 0.2 to 0.5% of Ni, 0.1 to 0.3% of Cr, 0.05 to 0.15% of Mo, 0.015 to 0.035% of Nb, 0.005 to 0.02% of Ti, 0.002 to 0.006% of N, 0.01% or less of P, 0.003% or less of S, with a balance of iron (Fe) and other inevitable impurities.

Carbon (C): 0.04 to 0.08%

Carbon (C) is an element which causes solid solution strengthening and exists as a carbonitride due to Nb, or the like to secure tensile strength, and a content of carbon (C) may be limited to 0.04% or more. On the other hand, when the carbon (C) content exceeds 0.08%, it not only promotes formation of MA, but also generates pearlite, which can deteriorate impact characteristics at low temperatures, and there may be a risk of deteriorating welding characteristics when welding a structure. A more preferable upper limit of the carbon (C) content may be 0.07%.

Silicon (Si): 0.1 to 0.35%

Silicon (Si) is an element which assists Al in deoxidizing molten steel and is necessary to secure yield strength and tensile strength, and a content of silicon (Si) may be 0.1% or more. However, if the Si content exceeds 0.35%, there may be a problem of inhibiting diffusion of C and encouraging the formation of MA. More preferably, 0.15% or more of silicon (Si) may be included, and even more preferably, 0.25% or less of silicon (Si) may be included.

Manganese (Mn): 1.4 to 1.8%

Since manganese (Mn) has a significant effect of increasing strength through solid solution strengthening, 1.4% or more of manganese (Mn) is preferably added. On the other, when a content of manganese (Mn) is excessive, it may cause a decrease in toughness due to formation of MnS inclusions and central segregation, so an upper limit of the Mn content may be limited to 1.8%. A more preferably lower limit of the Mn content may be 1.5%.

Aluminum (sol.Al): 0.01 to 0.035%

Aluminum (sol.Al) is a major deoxidizing agent in steel, and it is preferable to add 0.01% or more of aluminum (sol.Al) to obtain the effect. However, a content of aluminum (sol.Al) exceeds 0.035%, it may cause a decrease in low-temperature toughness due to an increase in a fraction and size of $Al_2O_3$ inclusions. In addition, similar to Si, there may be a risk of deteriorating low-temperature toughness characteristics by promoting the creation of a base material and MA in a weld heat-affected zone. More preferably, 0.015% or more of aluminum (sol.Al) may be included, and even more preferably, 0.03% or less of aluminum (sol.Al) may be included.

Nickel (Ni): 0.2 to 0.5%

Nickel (Ni) is an element which improves strength without deteriorating impact toughness, and may increase strength by promoting the formation of an appropriate amount of acicular ferrite, so it is preferable that 0.2% or more of nickel (Ni) is added. On the other hand, when a content of nickel (Ni) exceeds 0.5%, an Ar3 temperature may drop to form bainite, and accordingly, there may be a risk that impact toughness in an extremely thick material may decrease. A more preferable lower limit of the nickel (Ni) content may be 0.3%.

Chromium (Cr): 0.1 to 0.3%

Chromium (Cr) is a carbide-forming element, which is advantageous for securing strength, but in an extremely thick steel material, since coarse carbides may be formed depending on a cooling rate of steel, which may impede impact toughness, a content of chromium (Cr) may be limited to 0.1 to 0.3%. A more preferable lower limit of the Cr content may be 0.15%.

Molybdenum (Mo): 0.05 to 0.15%

Molybdenum (Mo) is an element which effectively increases strength with an addition of a small amount of Mo, and since Mo forms Mo—C-based precipitates to improve the strength, it is preferable that 0.05% or more of Mo is added. However, since coarsening of precipitates may occur due to excessive addition of molybdenum (Mo), an upper limit of the Mo content may be limited to 0.15%. A more preferable lower limit of the Mo content may be 0.08%, and a more preferable upper limit of the Mo content may be 0.12%.

Niobium (Nb): 0.015 to 0.035%

Niobium (Nb) is an element which suppresses recrystallization during rolling or cooling by forming a solid solution or precipitating carbonitrides, to make the structure finer and increase strength. Nb may be added in an amount of 0.015% or more. However, C concentration occurs due to C affinity and promotes MA production, which can reduce toughness and fracture characteristics at low temperatures, so an upper limit of the Nb content may be limited to 0.035%. A more preferable lower limit of the Nb content may be 0.02%, and a more preferable upper limit of the Nb content may be 0.03%.

Titanium (Ti): 0.005 to 0.02%

Titanium (Ti) may combine with oxygen or nitrogen to form precipitates. The precipitates contribute to refinement by suppressing coarsening of the structure, and play a role in improving toughness, so it is preferable that Ti is added in an amount of 0.001% or more. However, if a content of Ti exceeds 0.02%, there is a risk that it may cause destruction due to coarsening of the precipitates. A more preferable lower limit of the Ti content may be 0.01%, and a more preferable upper limit of the Ti content may be 0.018%.

Nitrogen (N): 0.002 to 0.006%

Nitrogen (N) forms precipitates with Ti, Nb, Al, and the like, and when reheated, N may help improve strength and toughness by refining an austenite structure. However, when N is contained excessively, it may cause surface cracks and form precipitates at high temperatures, and the remaining nitrogen (N) exists in an atomic state and may reduce toughness, so a content of nitrogen (N) should be limited to 0.002 to 0.006%.

Phosphorus (P): 0.01% or less

Phosphorus (P) is an element causing grain boundary segregation and can cause embrittlement, so an upper limit of a content of phosphorous (P) may be limited to 0.01%. However, 0% may be excluded considering an avoidably added level.

Sulfur(S): 0.003% or less

Sulfur(S) may mainly combine with Mn to form MnS inclusions, which can be a factor impairing low-impact toughness. Therefore, in order to secure low-temperature toughness and low-temperature fatigue properties, an upper limit of a content of S may be limited to 0.003%. However, 0% may be excluded considering an avoidably added level.

The steel of the present disclosure may include remaining iron (Fe) and unavoidable impurities in addition to the above-described composition. Since unavoidable impurities may be unintentionally incorporated in a common manufacturing process, the component may not be excluded. Since these impurities are known to any person skilled in the common manufacturing process, the entire contents thereof are not particularly mentioned in the present specification.

In particular, copper (Cu) may be added as an impurity, but in the present disclosure, a content of copper (Cu) may be limited to less than 0.05%.

The steel according to an aspect of the present disclosure may have an R value of 0.85 to 1.35, defined in Relational expression 1 below.

In the present invention, Relational expression 1 is proposed to secure strength and low-temperature toughness at −50° C. at the same time. Relational expression 1 relates to a component formula for securing strength and toughness, and the strength and low-temperature toughness may be secured by controlling an R value of Relational expression 1. When the R value of Relational expression 1 is less than 0.85, there is a problem in that the desired yield strength may not be secured due to insufficient solid solution strengthening, precipitation strengthening, hardenability, and the like, and when the R value of Relational expression 1 exceeds 1.35, hard structures such as MA, bainite, and the like may be formed, resulting in inferior impact toughness.

$$R = [Ni] + 3[Mo] + 2[Cr] \quad \text{[Relational expression 1]}$$

where [Ni], [Mo], and [Cr] are a weight percent of each element.

Hereinafter, a microstructure of steel of the present disclosure will be described in detail.

In the present disclosure, unless specifically stated otherwise, % indicating a fraction of microstructure is based on area.

The steel according to an aspect of the present disclosure may comprise by area fraction: 40 to 60% of acicular ferrite, 40 to 60% of bainite, and 3% or less of a sum of residual cementite and MA as a microstructure at a point equal to ¼ of a thickness thereof.

In the present disclosure, in order to implement impact toughness at −50° C. at the point equal to ¼ of the thickness, a size, dislocation density, and the like of acicular ferrite are important, and it is preferable to minimize cementite and MA. More preferably, 2% or less of a sum of cementite and MA may be included. In the present disclosure, a point equal to ¼ of the thickness thereof is t/4, where t is a thickness of the steel plate.

The steel according to an aspect of the present disclosure may have an average grain size of acicular ferrite at a point equal to ¼ of the thickness of 20 μm or less.

In the present disclosure, the average grain size of acicular ferrite may be limited to 20 μm or less to ensure low-temperature impact toughness. If the size exceeds 20 μm, there may be a problem of reduced impact toughness. Meanwhile, due to the characteristics of a thick steel plate with a thickness of 50 mm or more, targeted in the present disclosure, there is a limitation in refinement of the grains, so a lower limit of the size may be limited to 10 μm.

The steel according to an aspect of the present disclosure may include by area fraction, 5% or less of a hard phase as a microstructure in a portion 8 mm directly below a surface portion.

In the present disclosure, in order to secure the desired impact toughness after deformation, a fraction of the hard phase in the microstructure directly below the surface portion may be limited to 5% or less. When the fraction of the hard phase exceeds 5%, there is a problem that it acts as a starting point for impact toughness fracture, and impact toughness may be inferior. In the present disclosure, the hard phase may be an MA phase, which is a combination of martensite and austenite.

Hereinafter, a method for manufacturing steel of the present disclosure will be described in detail.

The steel according to an aspect of the present disclosure may be manufactured by reheating, rolling, and cooling a steel slab satisfying the above-described alloy composition.

Reheating

A steel slab satisfying the alloy composition of the present disclosure may be reheated to a temperature within a range of 1020 to 1100° C.

If a reheating temperature is higher than 1100° C., austenite grains may become coarse, which may reduce toughness due to the development of bainite structure due to increased hardenability. On the other hand, if the reheating temperature is lower than 1020° C., Ti, Nb, and the like may not be sufficiently dissolved, which may result in a decrease in strength.

Rolling in a Recrystallization Zone

The reheated steel slab may be rolled in a recrystallization zone with an amount of reduction of final pass of 15 to 25 mm in a temperature range of 900° C. or higher.

In the present disclosure, the operation of rolling in a recrystallization zone is performed for completely recrystallizing austenite, and suppressing the refinement and growth of austenite. Rolling in a recrystallization zone is preferably performed in a temperature range of 900° C. or higher for complete austenite recrystallization, and an amount of reduction of final pass may be 15 to 25 mm for initial austenite refinement. If the amount of reduction of final pass is less than 15 mm, it may be difficult to secure the desired level of refinement. Meanwhile, during rolling, the upper limit may be limited to 25 mm in consideration of productivity according to equipment specifications.

Rolling in a Non-Recrystallization Zone

The steel plate rolled in the recrystallization zone may be rolled in a non-recrystallization zone at a rolling end temperature of Ar3+40 Ar3+80 and a cumulative reduction ratio of 30 to 50%.

In the present disclosure, the rolling finish temperature may be sufficiently increased to prevent a temperature in a surface portion after rolling and before cooling begins. If the rolling finish temperature is lower than Ar3+40, the temperature in the surface portion before cooling falls below the Ar3 temperature, in a two-phase region, grain boundary concentration of C may occur, due to cooling, it may be transformed into a phase with high hardness, which can have a very negative effect on impact toughness after deformation. On the other hand, if the temperature is higher than Ar3+80, it becomes difficult to achieve grain refinement at the point equal to ¼ of the thickness, and there is a risk that impact toughness at −50° C. may decrease.

In addition, it is preferable that a thick material with a thickness of 50 mm or more has a cumulative reduction ratio is 30 to 50%. If the cumulative reduction ratio is less than an amount 30%, of rolling in the non-recrystallization zone is reduced, causing problems such as pancaking of the structure and difficulty in refining, and if the cumulative reduction ratio exceeds 50%, there is a risk that the low-temperature impact toughness may be deteriorated due to the insufficient amount of rolling in the recrystallization zone.

$$Ar3=910-310[C]-80[Mn]-20[Cu]-15[Cr]-55[Ni]-80[Mo] \quad \text{[Equation]}$$

where [C], [Mn], [Cu], [C], [Ni], and [Mo] are a weight percent of each element.

Cooling

The steel plate rolled in the non-recrystallization zone may be cooled to a temperature range of 400° C. or lower at a cooling rate of 5 to 10° C./s based on a point equal to ¼ of a thickness thereof.

It is preferable for the thick steel plate targeted in the present disclosure to secure impact toughness around ¼ of the thickness. Therefore, a cooling rate limited in the present disclosure may be based on the point equal to ¼ of the thickness. If the cooling end temperature is higher than 400° C. or the cooling rate exceeds 10° C./s, the formation of MA may be promoted and impact toughness may be inferior. On the other hand, if the cooling rate is less than 5° C./s, it may be difficult to secure the desired level of strength. In the present disclosure, water cooling can be used as a cooling method.

The steel of the present disclosure manufacture in this manner may have thickness of 50 to 100 mm, a yield strength of 460 MPa or more, a tensile strength of 580 MPa or more, and an impact toughness of 100 J or more at −50° C. on the surface and at a point equal to ¼ of the thickness after deformation, and have high strength and excellent impact toughness properties after deformation.

Hereinafter, the present disclosure will be described in more detail through examples. It should be noted that the following examples are only for understanding of the present invention, and are not intended to specify the scope of the present invention. The scope of the present invention may be determined by the matters described in the claims and the matters reasonably inferred therefrom.

MODE FOR INVENTION

Example

After preparing molten steel having the alloy composition shown in Table 1 below, a slab was manufactured using continuous casting. The slab was reheated, rolled, and cooled under the conditions shown in Table 2 below to manufacture a steel plate. A rolling temperature in a recrystallization zone, not disclosed in Table 2 was applied equally at a temperature of 900° C. or higher, and when rolling was performed in a non-recrystallization zone, a cumulative reduction ratio was applied equally within a range of 30 to 50%. In addition, Table 1 showed the calculated Ar3 temperature and R value of Relational expression 1 according to the alloy composition of each steel type.

TABLE 1

| STEEL | ALLOY COMPOSITION (wt %) | | | | | | | | | | | | Ar3 | RELATIONAL EXPRESSION |
|---|---|---|---|---|---|---|---|---|---|---|---|---|---|---|
| TYPE | C | Si | Mn | P | S | Al | Ni | Cr | Mo | Ti | Nb | N | (° C.) | 11 |
| A | 0.054 | 0.15 | 1.63 | 0.0073 | 0.0017 | 0.022 | 0.34 | 0.22 | 0.11 | 0.012 | 0.023 | 0.0035 | 732 | 1.11 |
| B | 0.062 | 0.14 | 1.57 | 0.0080 | 0.0015 | 0.025 | 0.38 | 0.20 | 0.08 | 0.012 | 0.024 | 0.0042 | 735 | 1.02 |
| C | 0.064 | 0.18 | 1.54 | 0.0067 | 0.0017 | 0.025 | 0.42 | 0.18 | 0.11 | 0.013 | 0.022 | 0.0040 | 732 | 1.11 |

TABLE 1-continued

| STEEL | ALLOY COMPOSITION (wt %) | | | | | | | | | | | | Ar3 | RELATIONAL EXPRESSION |
|---|---|---|---|---|---|---|---|---|---|---|---|---|---|---|
| TYPE | C | Si | Mn | P | S | Al | Ni | Cr | Mo | Ti | Nb | N | (° C.) | 11 |
| D | 0.060 | 0.14 | 1.62 | 0.0081 | 0.0015 | 0.019 | 0.11 | 0.04 | 0.04 | 0.013 | 0.025 | 0.0041 | 752 | 0.31 |
| E | 0.055 | 0.18 | 1.57 | 0.0087 | 0.0017 | 0.024 | 0.64 | 0.37 | 0.19 | 0.012 | 0.026 | 0.0036 | 711 | 1.95 |
| F | 0.06 | 0.18 | 1.63 | 0.0091 | 0.0022 | 0.025 | 0.41 | 0.23 | 0.1 | 0.012 | 0.026 | 0.040 | 727 | 1.17 |
| G | 0.058 | 0.15 | 1.58 | 0.0086 | 0.0015 | 0.024 | 0.38 | 0.20 | 0.08 | 0.011 | 0.021 | 0.0038 | 735 | 1.02 |
| H | 0.054 | 0.18 | 1.55 | 0.0078 | 0.0016 | 0.029 | 0.41 | 0.18 | 0.09 | 0.013 | 0.025 | 0.0036 | 737 | 1.04 |
| I | 0.062 | 0.14 | 1.62 | 0.0082 | 0.0020 | 0.023 | 0.40 | 0.23 | 0.11 | 0.012 | 0.024 | 0.0042 | 727 | 1.19 |
| J | 0.063 | 0.15 | 1.63 | 0.09 | 0.012 | 0.024 | 0.41 | 0.17 | 0.1 | 0.012 | 0.023 | 0.039 | 727 | 1.05 |
| K | 0.062 | 0.14 | 01.62 | 0.083 | 0.011 | 0.023 | 0.49 | 0.28 | 0.13 | 0.011 | 0.024 | 0.0036 | 720 | 1.44 |

$$R = [Ni] + 3[Mo] + 2[Cr] \quad \text{[Relational expression 1]}$$

where [Ni], [Mo], and [Cr] are a weight percent of each element.

$$Ar3 = 910 - 310[C] - 80[Mn] - 20[Cu] - 15[Cr] - 55[Ni] - 80[Mo] \quad \text{[Equation]}$$

where [C], [Mn], [Cu], [Cr], [Ni], and [Mo] are a weight percent of each element.

TABLE 2

| SPECIMEN NO. | STEEL TYPE | REHEATING TEMPERATURE (° C.) | ROLLING IN RECRYSTALLIZATION ZONE: AMOUNT OF REDUCTION OF FINAL PASS (%) | ROLLING IN NON-RECRYSTALLIZATION ZONE: FINISH TEMPERATURE (° C.) | COOLING: FINISH TEMPERATURE (° C.) | COOLING: COOLING RATE (° C./s) |
|---|---|---|---|---|---|---|
| 1 | A | 1091 | 17.8 | 805 | 384 | 6.7 |
| 2 | B | 1086 | 18.2 | 813 | 365 | 7.5 |
| 3 | C | 1095 | 16.8 | 811 | 355 | 6.3 |
| 4 | D | 1090 | 19.4 | 816 | 386 | 8.1 |
| 5 | E | 1087 | 18.2 | 787 | 342 | 6.7 |
| 6 | F | 1082 | 18.3 | 875 | 385 | 6.8 |
| 7 | G | 1083 | 17.4 | 772 | 364 | 7.6 |
| 8 | H | 1091 | 16.8 | 814 | 394 | 13.8 |
| 9 | I | 1090 | 18.1 | 804 | 572 | 7.4 |
| 10 | J | 1089 | 10.4 | 804 | 322 | 8.1 |
| 11 | K | 1091 | 19.3 | 789 | 354 | 7.8 |

In Table 3 below, a microstructure of the manufactured steel plate was measured and described. A fraction of a hard phase directly below was obtained by observing the microstructure, and a fraction of MA was measured as the hard phase. As the microstructure at a point equal to ¼ of the thickness, the fractions of acicular ferrite (AF), cementite, and MA were shown, respectively, and the remaining fraction thereof was observed to be bainite. In addition, an acicular ferrite grain size at a point equal to ¼ of the thickness of the steel was measured and shown. The microstructure was measured using an optical microscope at 500× magnification.

In addition, in Table 3, physical property values for each manufactured specimen were measured and shown. A yield strength (YS), tensile strength (TS), and elongation (El) were evaluated through a tensile test and evaluated according to the EN-ISO 6892-1 standard, and a circular specimen was collected in a direction perpendicular to rolling at a point equal to ¼ of the thickness, and an average of two tests was measured. In addition, impact toughness values at −50° C. were measured. For the impact toughness, a specimen was collected in a direction parallel to rolling at a point equal to ¼ of the thickness according to the EN ISO 148-1 standard, and an average of three tests was measured. For a deformation impact test, a tensile specimen with a length of 450 mm was produced, and when an amount of deformation during tensioning reached 5%, tensioning was stopped and an aging treatment was performed at 250° C. Thereafter, the impact specimen was measured in the same manner as the base material impact test.

TABLE 3

| | | MICROSTRUCTURE | | | | PHYSICAL PROPERTY | |
|---|---|---|---|---|---|---|---|
| | | AT A POINT EQUAL TO ¼ OF THICKNESS | | | DIRECTLY BELOW SURFACE | | |
| SPECIMEN NO. | STEEL TYPE | AF (%) | CEMENTITE AND MA (%) | AF GRAIN SIZE (μm) | HARD PHASE (%) | YIELD STRENGTH (MPa) | TENSILE STRENGTH (MPa) |
| 1 | A | 54 | 1.2 | 18.5 | 2.4 | 512 | 619 |
| 2 | B | 52 | 0.9 | 17.3 | 1.2 | 486 | 618 |
| 3 | C | 49 | 1.1 | 18.2 | 1.1 | 492 | 615 |
| 4 | D | 68 | 10.8 | 17.8 | 2.5 | 422 | 544 |
| 5 | E | 23 | 1.3 | 19.3 | 5.2 | 546 | 662 |
| 6 | F | 63 | 1.4 | 26.4 | 2.1 | 523 | 621 |
| 7 | G | 33 | 1.5 | 17.0 | 21 | 518 | 619 |
| 8 | H | 31 | 1.5 | 18.6 | 12 | 486 | 634 |
| 9 | I | 62 | 3.3 | 19.5 | 1.3 | 478 | 635 |
| 10 | J | 46 | 1.3 | 25.8 | 1.2 | 442 | 582 |
| 11 | K | 35 | 3.5 | 18.3 | 6.2 | 475 | 645 |

| | PHYSICAL PROPERTY | | | | |
|---|---|---|---|---|---|
| | | IMPACT TOUGHNESS (−50° C., J) | | | |
| | | BEFORE DEFORMATION | AFTER DEFORMATION | | |
| SPECIMEN NO. | ELONGATION (%) | AT A POINT EQUAL TO ¼ OF THICKNESS | AT A POINT EQUAL TO ¼ OF THICKNESS | SURFACE | DIVISION |
| 1 | 25 | 298 | 254 | 278 | INVENTIVE EXAMPLE 1 |
| 2 | 24 | 303 | 264 | 245 | INVENTIVE EXAMPLE 2 |
| 3 | 23 | 302 | 253 | 187 | INVENTIVE EXAMPLE 3 |
| 4 | 28 | 311 | 223 | 195 | COMPARATIVE EXAMPLE 1 |
| 5 | 24 | 57 | 23 | 78 | COMPARATIVE EXAMPLE 2 |
| 6 | 23 | 36 | 18 | 187 | COMPARATIVE EXAMPLE 3 |
| 7 | 22 | 275 | 213 | 15 | COMPARATIVE EXAMPLE 4 |
| 8 | 24 | 89 | 27 | 35 | COMPARATIVE EXAMPLE 5 |
| 9 | 25 | 187 | 36 | 187 | COMPARATIVE EXAMPLE 6 |
| 10 | 29 | 45 | 78 | 89 | COMPARATIVE EXAMPLE 7 |
| 11 | 27 | 36 | 32 | 45 | COMPARATIVE EXAMPLE 8 |

As shown in Table 3, in Inventive Example satisfying the alloy composition and manufacturing conditions of the present disclosure, the microstructure characteristics proposed in the present disclosure were satisfied and the physical properties desired in the present disclosure were secured.

Figure 1B:
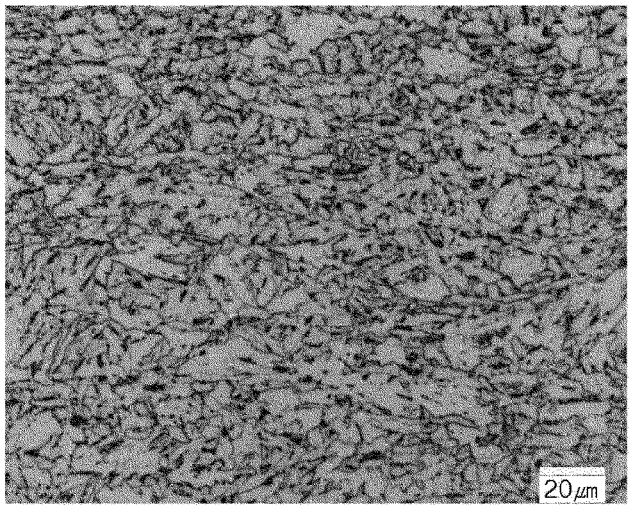

FIGS. 1(A) and 1(B) are photographs of a microstructure of Inventive Example according to an aspect of the present disclosure observed at 500× magnification using an optical microscope. FIG. 1(A) is a photograph of the microstructure at 8 mm below the surface, and FIG. 1(B) is a photograph of the microstructure at ¼ the thickness.

Figure 2:
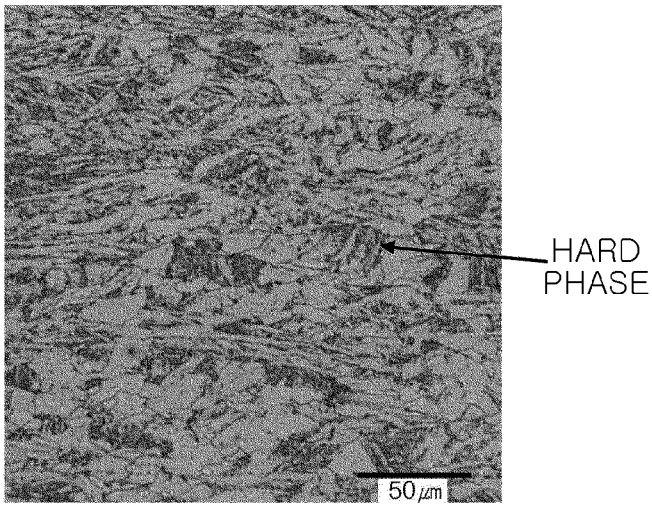
FIG. 2 is a photograph of a microstructure of Comparative Example 4 according to an aspect of the present disclosure observed at 500× magnification using an optical microscope.

FIG. 2 is a photograph of a microstructure of Comparative Example 4 according to an aspect of the present disclosure observed at 500× magnification using an optical microscope.

On the other hand, Comparative Examples 1 and 2 are examples in which the alloy composition is not satisfied. Comparative Example 1 showed a decrease in strength due to a decrease in hardenability of a base material as a value of Relational expression 1 was insufficient. In Comparative Example 2, the value of Relational expression 1 was exceeded and the formation of MA was promoted, resulting in inferior impact properties after deformation due to an increase in the fraction of MA. In addition, a hard phase was developed due to an increase in surface hardenability, resulting in inferior impact toughness after surface deformation.

Comparative Example 3 showed a case in which a rolling temperature in a non-recrystallization zone was excessive, the impact toughness after impact and deformation at a point equal to ¼ of the thickness was inferior due to lack of grain refinement.

Comparative Example 4 showed a case in which a rolling temperature in a non-recrystallization zone was therebelow, the impact toughness at a point equal to ¼ of the thickness due to the grain refinement effect was excellent, but due to entering a local two-phase region before cooling a surface portion, the distribution of the hard phase after cooling has increased significantly. As a result, the impact toughness properties after surface deformation were very poor.

In the case of Comparative Example 5, a cooling rate exceeded the range of the present disclosure and the hard phase increased due to supercooling in the surface portion, resulting in poor impact toughness after surface deformation.

Comparative Example 6 showed a case in which a cooling end temperature was too high, and in Comparative Example 6, the formation of MA at a point equal to ¼ of the thickness rapidly increased, resulting in poor impact toughness after deformation.

In Comparative Example 7, a final ferrite size could not be refined due to insufficient initial austenite refinement due to an insufficient amount of reduction when rolling is performed in a recrystallization zone, a hard phase was easily formed from coarse austenite, and it could be confirmed that a decrease in yield strength and impact toughness were shown.

Comparative Example 8 showed a case in which the alloy component content proposed in the present disclosure is satisfied, but the value of Relational expression 1 is not satisfied. In Comparative Example 8, it could be confirmed that the operating conditions and temperature ranges proposed therein were satisfied, so the strength was sufficiently satisfied, but due to a decrease in acicular ferrite, an increase in bainite, and an increase in a hard phase in a surface portion, the impact toughness at −50° C. and the impact toughness dropped sharply after surface deformation.

While example embodiments have been shown and described above, it will be apparent to those skilled in the art that modifications and variations could be made without departing from the scope of the present disclosure as defined by the appended claims.

The invention claimed is:

1. A steel plate, comprising by weight %:

0.04 to 0.08% of C, 0.1 to 0.35% of Si, 1.4 to 1.8% of Mn, 0.01 to 0.035% of sol.Al, 0.2 to 0.5% of Ni, 0.1 to 0.3% of Cr, 0.05 to 0.15% of Mo, 0.015 to 0.035% of Nb, 0.005 to 0.02% of Ti, 0.002 to 0.006% of N, 0.01% or less of P, 0.003% or less of S, with a balance of iron (Fe) and other inevitable impurities, wherein an R value defined in Relational expression 1 below is 0.85 to 1.35, a microstructure at a point equal to ¼ of a thickness of the steel plate consists of by area fraction, 40 to 60% of acicular ferrite, 40 to 60% of bainite, and 3% or less of a sum of residual cementite and MA, an average grain size of acicular ferrite at the point equal to ¼ of the thickness is 20 μm or less, and a microstructure in a portion 8 mm directly below a surface portion comprises by area fraction, 5% of a hard phase, wherein the hard phase is an MA phase, $$R = [Ni] + 3[Mo] + 2[Cr] \quad \text{[Relational expression 1]}$$

where [Ni], [Mo], and [Cr] are a weight percent of each element.

2. The steel plate of claim 1, wherein the steel plate has an average grain size of acicular ferrite at the point equal to ¼ of the thickness of the steel plate of 10 to 20 μm.

3. The steel plate of claim 1, wherein the steel plate has a thickness of 50 to 100 mm.

4. The steel plate of claim 1, wherein the steel plate has a yield strength of 460 MPa or more, and a tensile strength of 580 MPa or more.

5. The steel plate of claim 1, wherein the steel plate has an impact toughness of 100 J or more at −50° C. on a surface and at a point equal to ¼ of the thickness after deformation, where deformation means that when an amount of deformation reaches 5%, during tensioning, tensioning is stopped and then an aging treatment is performed at 250° C.

* * * * *